United States Patent [19]

Bubik et al.

[11] 4,137,124

[45] Jan. 30, 1979

[54] HEAD BOX FOR A PAPERMAKING MACHINE

[75] Inventors: Alfred Bubik; Hans-Joachim Schultz, both of Ravensburg, Germany

[73] Assignee: Escher Wyss GmbH, Ravensburg, Germany

[21] Appl. No.: 793,258

[22] Filed: May 3, 1977

[30] Foreign Application Priority Data

May 11, 1976 [CH] Switzerland ..... 5871/76

[51] Int. Cl.[2] ..... D21F 1/02; D21F 1/06

[52] U.S. Cl. ..... 162/343; 162/344

[58] Field of Search ..... 162/343, 344, 347, 336, 162/216

[56] References Cited

U.S. PATENT DOCUMENTS

| | | | |
|---|---|---|---|
| 3,215,593 | 11/1965 | Green | 162/344 X |
| 3,725,197 | 4/1973 | Dahl et al. | 162/343 |
| 3,769,155 | 10/1973 | Schiel | 162/343 |
| 3,923,593 | 12/1975 | Verseput | 162/343 X |

*Primary Examiner*—Richard V. Fisher

*Attorney, Agent, or Firm*—Kenyon & Kenyon, Reilly, Carr & Chapin

[57] ABSTRACT

The head box is provided with a distributor having a plurality of pulp distributing ducts which have terminal sections converging towards the throat of the box. The distributing ducts also have step-like widenings upstream of the terminal sections to create a strong turbulence in the pulp flow to maintain the solids content of the pulp in suspension. The terminal sections terminate short of the throat so as to reduce any risk of cross-flow and thus improve the flow of the pulp.

10 Claims, 6 Drawing Figures

HEAD BOX FOR A PAPERMAKING MACHINE

This invention relates to a head box for a papermaking machine.

As is known, head boxes for papermaking machines are generally constructed with a pulp distributor having a large number of distributing ducts through which pulp may flow in parallel streams. In some cases, the distributing ducts have been provided with stepped widenings so as to produce a strong turbulence in the pulp flow. Further, it has been known to construct the distributors with a nozzle duct bounded by side walls which converge in the direction of pulp flow and which is formed with a pulp exit throat. A head box of this kind is known, for example, from Swiss Patent Specification No. 518,406 (equivalent to U.S. Pat. No. 3,725,197). In operation, the pulp generally passes through the parallel distributing ducts only as far as the beginning of the converging nozzle duct. Thereafter, the streams of pulp are exposed to each other.

In most cases, a head box construction of the above type is completely satisfactory. However, there is a risk of a cross flow forming in the nozzle duct which might impair distribution of the solids in the pulp suspension. As a result, a head box is usually constructed to handle only a relatively narrow range of pulp densities.

Accordingly, it is an object of the invention to provide a head box in which a flow of pulp is guided in an efficient manner.

It is another object of the invention to provide a head box which is capable of use for a relatively wide range of pulp densities.

It is another object of the invention to provide a head box which meets very stringent requirements with respect to the distribution of solids suspended in the pulp.

Briefly, the invention provides a head box for a paper making machine which comprises a pair of oppositely disposed side walls which converge towards each other to form a nozzle duct and a pulp exit throat at one end of the nozzle duct and a distributor between the side walls of the nozzle duct. This distributor has a plurality of pulp distributing ducts which extend therethrough towards the throat of the nozzle duct. Each of these ducts has at least one step-like widening. In addition, an insert is mounted on the distributor between the side walls to form terminal sections of the distributing ducts. To this end, each terminal section is located downstream of the respective widening relative to a flow of pulp. Further, the terminal sections of the ducts are disposed to converge towards the throat of the nozzle duct.

The convergence of the termal sections of the distributing ducts towards the throat ensures guidance of the pulp by the ducts until very near the throat. As a result, the flow of pulp is subject to improved smoothing with less risk of any appreciable cross-flow.

In one embodiment, the terminal sections can be formed by an insert which can be incorporated into existing head boxes, for example by securing the insert to the end of a distributing block. The insert is also formed with parallel intermediate sections upstream of the terminal sections which form continuations of the distributing ducts in the distributing block.

In another embodiment, an insert which forms the converging terminal sections may be directly mounted on an existing distributing block. In this embodiment, the insert may be formed of a plurality of walls which are disposed at right angles to each other in intersecting relation.

In still another embodiment, each distributing duct may have a pair of consecutively arranged sections disposed on opposite sides of the widening with the section downstream of the widening being of a narrowing cross-sectional shape in the pulp flow direction. In this embodiment, an insert forming the terminal sections of the distributing ducts can be more readily mounted on the distributing block. In this case also, the insert may be formed of a plurality of bent walls and interconnecting walls which form terminal duct sections of pentagonal and hexagonal cross-sections.

In still another embodiment, the distributing ducts may converge toward the throat with each duct extending along a straight centerline.

In the embodiment where the distributing duct has an intermediate section downstream of a step-like widening which narrows in the pulp flow direction, turbulence is greater than in a cylindrical distributing duct. In such a construction, it is simpler to fabricate a connection for the terminal converging portions of the distributing ducts since relatively large webs exist between the exit orifices of the narrowing sections of the narrowing distributing ducts.

The nozzle duct includes a pair of adjustably mounted lips which form the side walls and which are adjustable in the planes of the side walls so as to vary the size of the throat. It is thus possible to vary the throat size without effecting the flow conditions in and after the distributing ducts. The lips can, of course, be fixedly disposed so as to bound a constant throat width.

The terminal sections of the distributing ducts which are disposed in the central region of the nozzle duct can be made longer than the distributing ducts in the outer regions near the nozzle duct sidewalls. This feature may sometimes lead to a considerable simplification of the construction of the insert or distributor part comprising the terminal portions of the distributing ducts.

These and other objects and advantages of the invention will become more apparent from the following detailed description and appended claims taken in conjunction with the accompanying drawings in which:

Figure 1:
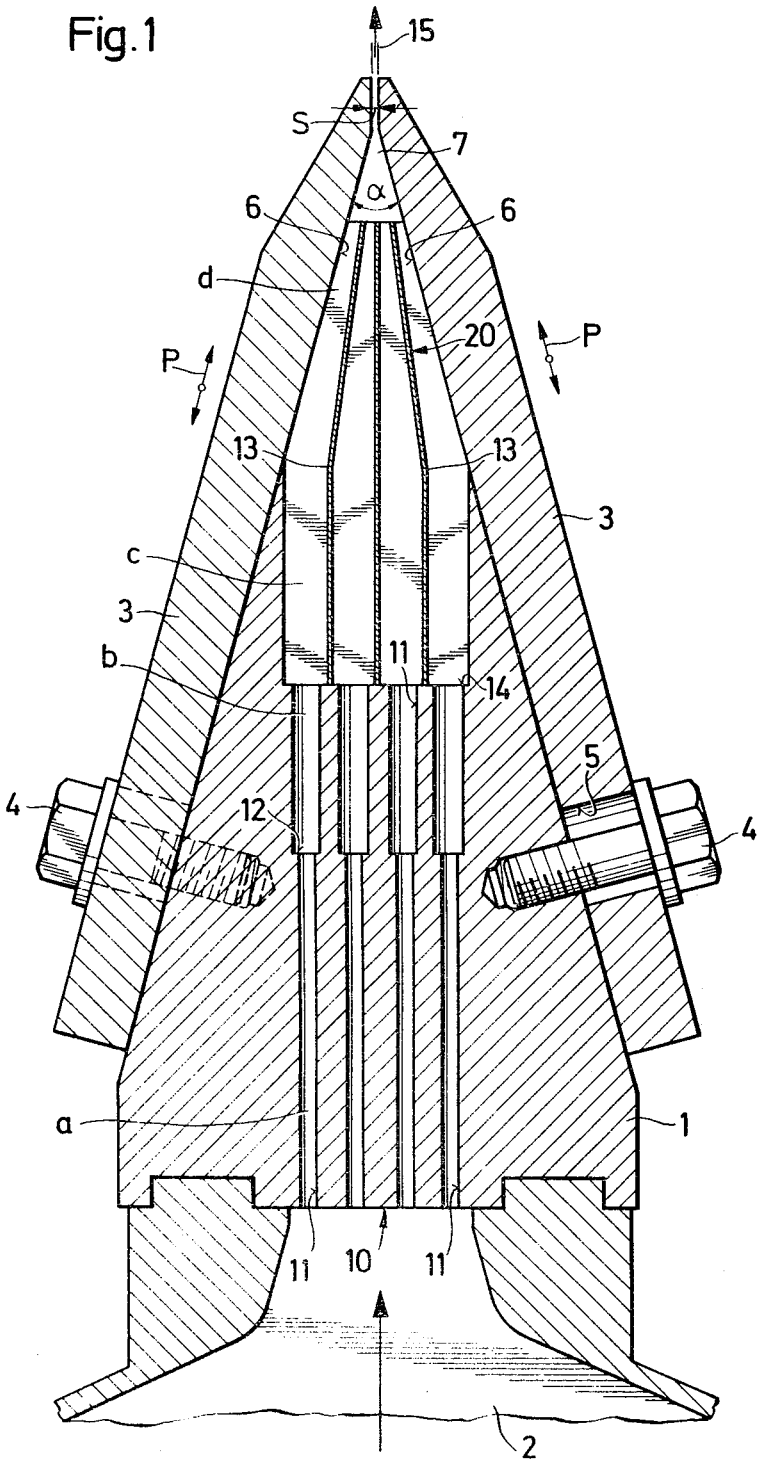
FIG. 1 illustrates a partial cross-sectional view of a head box having a distributor and a nozzle duct in accordance with the invention.

Referring to FIG. 1, the head box of a paper making machine includes a distributing block 1 which is mounted on and secured to a feed or supply pipe 2 for pulp. The supply pipe 2, as is known, receives a flow of pulp from a suitable source. A pair of plates or lips 3 are secured by means of screws 4 and elongated slots 5 to lateral inclined surfaces of the distributing block 1. These lips 3 form a pair of oppositely disposed side walls 6 which converge towards each other at an inclined angle $\alpha$ so as to form a nozzle duct 7 and a pulp exit throat S.

The distributing block 1 serves to distribute a flow of pulp from the pipe 2 into and through the nozzle duct 7. To this end, the distributing block includes a pulp-guiding distributor 10 having a plurality of pulp distributing ducts 11. As shown, each duct 11 has a pair of consecutively arranged cylindrical sections a, b which are separated by a stepped widening 12. The distributor also includes an insert 20 which forms continuations c, d of the distributing ducts. As shown, the insert 20 is mounted on webs between the duct sections b such that the duct sections c extend immediately from the outlets of the duct sections b. These duct sections c are in parallel and extend to a bend 13 before merging into the terminal sections d. These terminal sections d are disposed to converge towards the pulp exit throat S while the wall thickness of the insert 20, as shown, remain constant. As shown, the bend 13 is located in the same plane as the end of the distributor proper. As indicated, the lips 3 are adjustable in the directions indicated by the arrows P in the plane of the nozzle duct sidewalls 6 to the extent permitted by the clearance associated with the slots 5. This parallel adjustment of the lips 3 allows a means of adjusting the size of the throat S without also altering the shape of the duct 7 and effecting the flow therethrough.

In operation, the pulp flows from the pipe 2 into the distributing ducts 11. At the step 12 forming the transition between the sections a, b of the ducts 11, and at similar step-like transitions 14 between the duct sections b, c, a strong turbulence is produced in the pulp flow in known manner to help maintain the solids content of the pulp in suspension. The turbulent pulp then moves from the straight parallel sections of the distributor 10 into the converging duct sections d in the nozzle duct 7. Thereafter, the streams of pulp pass from the terminal sections d into the throat S and issue therefrom in the form of a single stream 15, for example to at least one dewatering element, such as a wire.

The terminal sections d of the distributing ducts 11 guide the pulp to very near the throat S. As a result, the part of the converging nozzle duct in which there is no guidance of the pulp is reduced considerably as compared to previously known structures.

Figure 2:
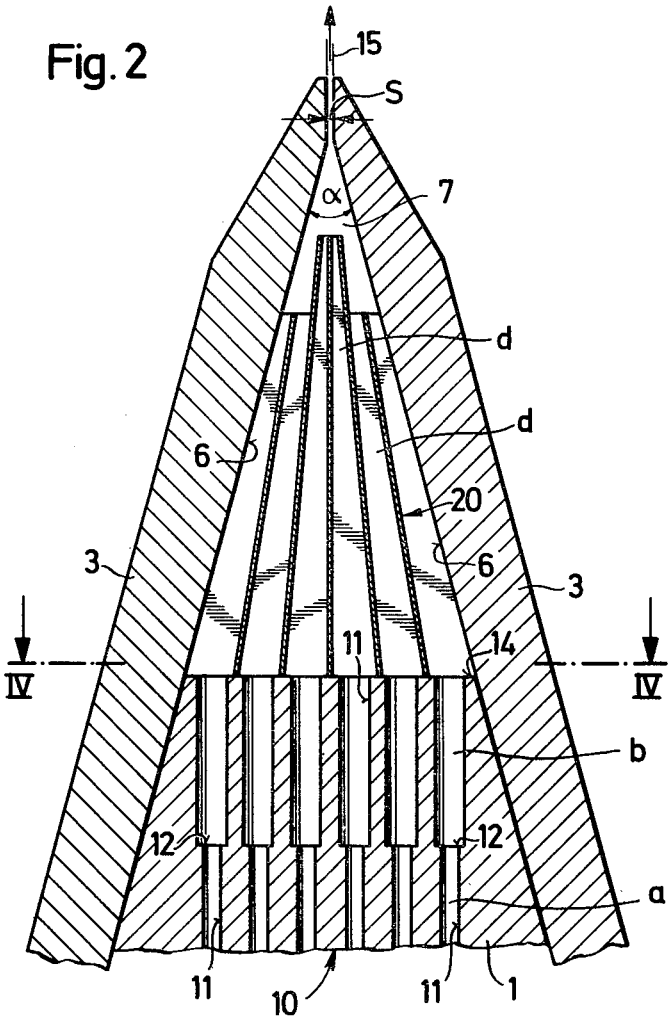
FIG. 2 illustrates a cross-sectional view of a modified head box having a distributing block and an insert in accordance with the invention.

Referring to FIG. 2, wherein like reference characters indicate like parts as above, the insert 20 is fabricated to form only the terminal sections d of the distributing ducts 11. In addition, the insert 20 is fabricated so that the terminal sections d of the ducts 11 in the central region of the nozzle duct 7 are longer than the terminal sections d in the outer region near the side walls 6. As also shown, the insert 20 is mounted at the end of the distributor proper rather than within a recess as in FIG. 1.

Figure 4:
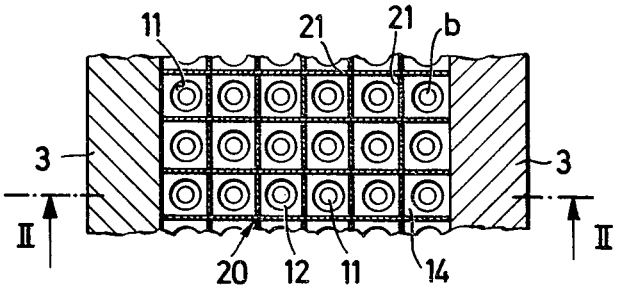
FIG. 4 illustrates a view taken on line IV—IV of FIG. 2.

Referring to FIG. 4, the insert 20 is formed by a plurality of plane walls 21 which are disposed at right angles to each other in intersecting relation.

Figure 3:
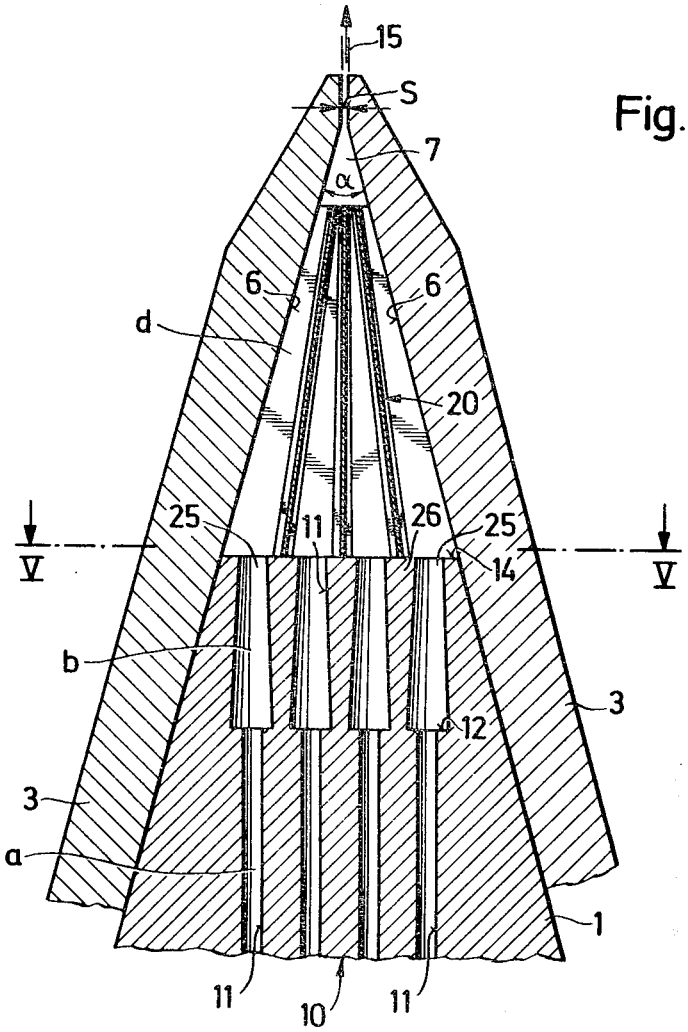
FIG. 3 illustrates a cross-sectional view of a modified head box in accordance with the invention.

Referring to FIG. 3, wherein like reference characters indicate like parts as above, the distributing duct portions d forming the final stage of the parallel sections of the distributing ducts in the distributor 10 have a shape which narrows in the pulp flow direction. Because of the narrowing or converging shape of the sections d, the webs 26 between the adjacent orifices 25 at the exit of the sections d are larger. This facilitates the connection of the insert 20 to the distributor proper.

Figure 5:
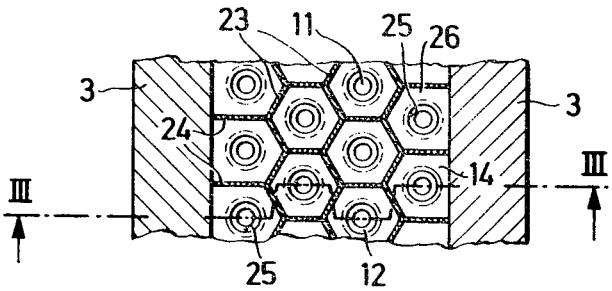
FIG. 5 illustrates a view taken on line V—V of FIG. 3.

Referring to FIG. 5, the insert 20 for the head box of FIG. 3 can include a plurality of bent walls and interconnecting walls 24 which form terminal duct sections d of pentagonal and hexagonal cross sections.

Figure 6:
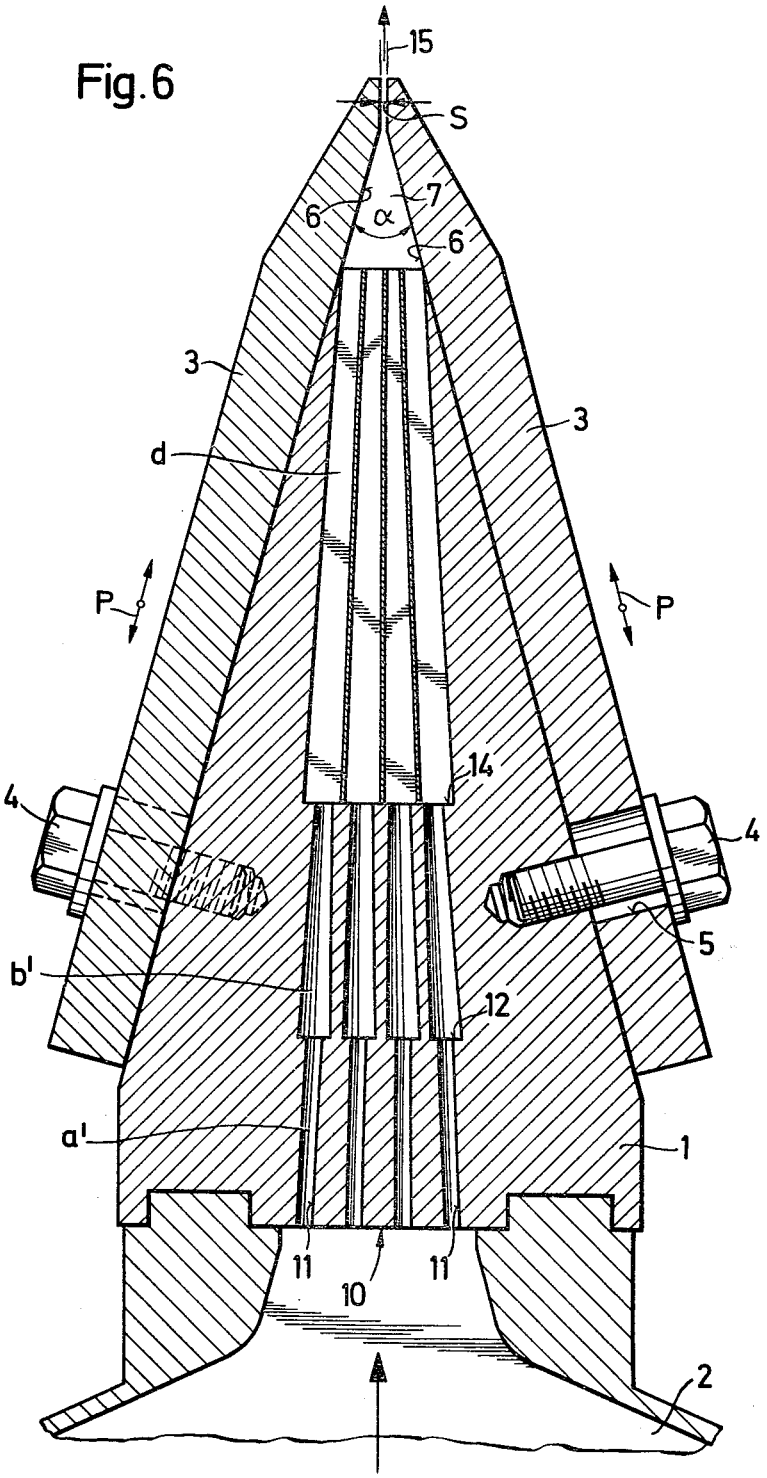
FIG. 6 illustrates a view of a further modified head box having a distributor and a nozzle duct in accordance with the invention.

Finally, referring to FIG. 6, wherein like reference characters indicate like parts as above, the distributor 10 may be formed with a plurality of distributor ducts 11 which converge toward the throat S with each duct 11 having cylindrical sections a', b' extending along a straight centerline. In this embodiment, there is no part having parallel duct sections.

What is claimed is:

1. A head box for a papermaking machine comprising a pair of oppositely disposed sidewalls converging towards each other to form a nozzle duct and a pulp exit throat at one end of said nozzle duct;

a distributor between said sidewalls of said nozzle duct, said distributor having a plurality of pulp distributing ducts extending therethrough towards said throat, each said duct having at least one step-like widening therein; and an insert mounted on said distributor between said sidewalls, said insert forming a plurality of terminal sections for said distributing ducts, each said terminal section being disposed in communication with a respective duct downstream of said widening therein relative to a flow of pulp therethrough, said terminal sections being disposed to converge towards said throat.

2. A head box as set forth in claim 1 wherein each said distributing duct has an intermediate section upstream of a respective terminal section, said intermediate sections of said distributing ducts extending in parallel to each other.

3. A head box as set forth in claim 2 wherein each said distributing duct has a pair of consecutively arranged sections disposed on opposite sides of said widening with said section downstream of said widening being of a narrowing cross-sectional shape in the pulp flow direction.

4. A head box as set forth in claim 1 wherein a pair of adjustably mounted lips form said sidewalls, said lips being adjustable in the planes of said sidewalls to vary the size of said throat.

5. A head box as set forth in claim 1 wherein said terminal sections in a central region of said nozzle duct are longer than said terminal sections in an outer region nearer said sidewalls.

6. A head box as set forth in claim 1 wherein said distributing ducts converge toward said throat with each said duct extending along a straight centerline.

7. A head box as set forth in claim 1 wherein said terminal sections converge towards said pulp exit throat while the wall thicknesses of said insert remain constant.

8. A head box for a papermaking machine comprising a supply pipe for receiving a flow of pulp;

a pair of oppositely disposed sidewalls converging towards each other to form a nozzle duct and a pulp exit throat;

a distributing block mounted on said supply pipe to distribute a flow of pulp from said pipe into and through said nozzle duct, said distributing block including a distributor having a plurality of pulp distributing ducts extending from said pipe towards said throat, each said duct having at least one step-like widening therein; and an insert mounted on said distributor between said sidewalls, said insert forming a plurality of terminal sections for said distributing ducts, each said terminal section being disposed in communication with a respective duct downstream of said widening relative to a flow of pulp therethrough, said terminal sections being disposed to converge towards said throat.

9. A head box as set forth in claim 8 wherein said insert includes a plurality of walls disposed at right angles to each other in intersecting relation.

10. A head box as set forth in claim 8 wherein said insert includes a plurality of bent walls and interconnecting walls forming terminal duct sections of pentagonal and hexagonal cross-sections.

* * * * *